United States Patent [19]

Ishida et al.

[11] Patent Number: 4,731,274

[45] Date of Patent: Mar. 15, 1988

[54] NAPPED FUSIBLE INTERLINING CLOTH WITH ADHESIVE POWDER ON TIPS OF NAP

[75] Inventors: Shumpei Ishida, Osaka; Sadao Obe, Itami, both of Japan

[73] Assignee: Nitto Boseki Co., Ltd., Fukushima, Japan

[21] Appl. No.: 71,754

[22] Filed: Jul. 9, 1987

[30] Foreign Application Priority Data

Jul. 11, 1986 [JP] Japan ..... 61-163181

[51] Int. Cl.[4] ..... B32B 3/02; B32B 33/00

[52] U.S. Cl. ..... 428/87; 427/26; 427/27; 427/180; 427/208.2; 427/288; 428/91; 428/196; 428/198; 428/200

[58] Field of Search ..... 428/87, 91, 196, 198, 428/200; 427/13, 26, 27, 180, 208.2, 288

[56] References Cited

U.S. PATENT DOCUMENTS

| | | | |
|---|---|---|---|
| 3,282,721 | 11/1966 | Iseki | 428/87 |
| 4,034,134 | 7/1977 | Gregorian et al. | 428/87 |
| 4,490,425 | 12/1984 | Knoke et al. | 428/200 |

*Primary Examiner*—Marion C. McCamish
*Attorney, Agent, or Firm*—Bert J. Lewen; Henry Sternberg

[57] ABSTRACT

This invention provides a fusible interlining which comprises a base fabric having naps distributed thereon, the surface of tip portion of the naps is applied with heat adhesive synthetic resin powders. Particle size of the powders is preferably 80μ or less. A method for production thereof is also provided.

9 Claims, 1 Drawing Figure

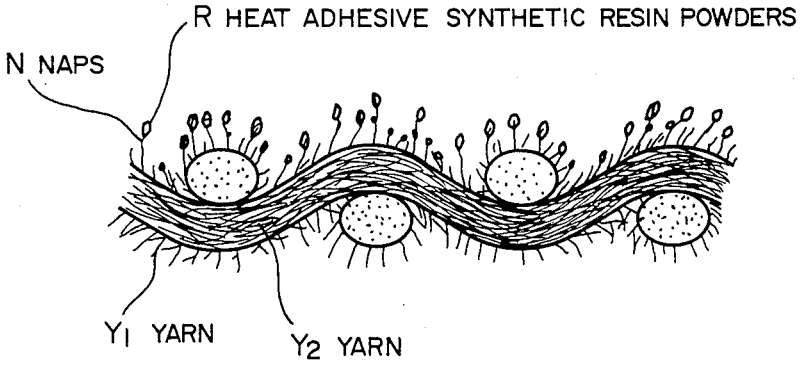
R HEAT ADHESIVE SYNTHETIC RESIN POWDERS
N NAPS
Y1 YARN
Y2 YARN

NAPPED FUSIBLE INTERLINING CLOTH WITH ADHESIVE POWDER ON TIPS OF NAP

BACKGROUND OF THE INVENTION

This invention relates to a heat fusible interlining cloth (hereinafter referred to as merely "fusible interlining") used mainly for shape making, shape retention and reinforcement of clothes, bags and the like and more particularly it relates to a fusible interlining which comprises a base fabric having thereon naps, the tip of naps being applied with heat adhesive synthetic resin fine powders and a method for making same.

Fusible interlinings have been known which comprise a base fabric such as a woven fabric, a knitted fabric, a non-woven fabric or the like on the surface of which heat adhesive synthetic resin materials are allowed to exist. Especially, as fusible interlinings for clothes, there are widely used those which have adhesive resins applied in the form of dots in order to keep feelings of shell fabric such as softeness, air permeability, handling, appearance, etc.

As these fusible interlinings having applied adhesive dots, there have been known those which are made by randomly scattering and fusion-bonding heat adhesive synthetic resin powders on a base fabric, by transfering and fusion-bonding small masses of the resin powders on a base fabric or by printing a paste containing the powders and drying them.

In case of the above mentioned conventional fusible interlinings having adhesive resins in the form of random points which are made by scattering resin powders, it is difficult to uniformly distribute the powders on the surface of a base fabric and besides, when particle size of the powders is too fine, the powders sink into the base fabric, resulting in reduction of adhesion efficiency and deterioration of softeness and air permeability of the base fabric. Therefore, generally, powders having narrow particle size distribution within the range of 100–250$\mu$ in diameter are used.

On the other hand, in case of those made by transferring or printing methods using engraved rollers, stencils, screens, etc., regular point distribution can be obtained, but when size of each dot is made small, the original pattern becomes unstable by clogging with resins. Therefore, the shapes of each dot are difficult to reduce to less than 0.1 mm in diameter.

For the above reasons, the adhesive portions in the form of dots in the conventional fusible interlinings are relatively large and when they are subjected to hot press bonding to shell fabric, tendency of the adhesive to strike through the front and back sides of the bonded fabric increases with increase in bonding area and this may cause deterioration of handle. Especially, it is very difficult to obtain fusible interlinings effective for light weight shell fabric.

SUMMARY OF THE INVENTION

As a result of researches on the state of application or deposition of heat adhesive synthetic resin powders on base fabric in an attempt to solve the problems in the conventional fusible interlinings, it has been found that when the resin powders are applied to only nap portions distributed on the surface of a base fabric, excellent adhesion state can be obtained and this invention has been accomplished based on this finding.

BRIEF DESCRIPTION OF THE DRAWING

The FIGURE is a diagrammatical enlarged cross-sectional view of one embodiment of fusible interlining of this invention.

DETAILED DESCRIPTION OF THE INVENTION

The first invention has the gist in a fusible interlining cloth, characterized in that heat adhesive synthetic resin powders are applied mainly to the surface of tip portion of each nap distributed on a base fabric and one embodiment of the invention is that said heat adhesive synthetic resin powders have a particle size of 80$\mu$ or less and said powders are fusion-bonded to the surface of naps.

The second invention is a method for making the fusible interlining of the first invention which comprises sprinkling charged powders of heat adhesive synthetic resin, suspension of said powders or fine particle emulsion of said resin onto a number of naps distributed on the fabric and standing on the fabric in electrostatic field, thereby to apply the resin powders mainly to the tip portions of the naps and then heating the fabric to fusion-bond the powders to the surface of the naps.

The base fabrics having naps distributed thereon include knitted fabrics made from spun yarns, non-woven fabrics made from short staples and base fabrics made from filaments which are provided with naps by cutting surface filaments. In some case, it is preferred to subject the fabric to singeing or shearing in order to make even the fiber length of naps.

As the powders of the heat adhesive synthetic resin powders, there may be used those of the known heat fusible resin materials, for example, synthetic resins and/or copolymer resins such as polyamide, polyester, polyethylene, polyurethane, polyvinyl chloride, ethylenevinyl acetate copolymer, mixtures thereof and mixtures of these resins and additives such as plasticizers if necessary. The particle size is 80$\mu$ or less in order that the powders can be applied stably to naps and good adhesion efficiency can be obtained.

When the particle size of the resin powder is more than 80$\mu$, the powders are also applied onto the base portion of naps depending on sprinkling means and uniform distribution of the powders is difficult. Thus, volume of the adhesive portions is increased and penetration of powders into the fabric produces hard texture, which often results in deterioration of handle of fabrics.

If the surface of resin powders are covered with a thin layer of water or a viscous solution at the time of sprinkling, they can be stably applied onto the surface of naps. On the other hand, when an electrostatic application means is employed, dry powders can also be stably applied. Of course, in this case, also the powders can be in the form of a dispersion in water and the like to cover the surface with water in order to obtain more excellent application state or an emulsion of fine particles of the resin may be sprinkled. The emulsion of fine particles are made into powders by removal of volatile matter.

When the resin powders applied onto naps are fusion-bonded by heating, a stable fusible interlining from which the powders are difficult to remove by external force can be obtained.

The fusible interlining of the first invention can be easily obtained by the production method of the second invention.

That is, the method of the second invention is characterized in that charged heat adhesive synthetic resin powders or suspension thereof or emulsion of fine particles of said resin are sprinkled onto a number of naps which are distributed on the surface of a base fabric and in the state of being raised in a high voltage electrostatic field, thereby applying the powders mainly to the tip portion of naps and then the powders are fusion-bonded to the surface of naps by heating.

In the above method for production of fusible interlinings, the base fabric and the heat adhesive synthetic resin powders are as stated above and the high voltage electrostatic field keeps normally a voltage gradient of 60–120 KV in the zone of sprinkling and application of resin powders, wherein the resin powders are charged.

The naps on the base fabric are in the state of being raises from the surface of the base fabric in said electrostatic field and the charged resin powders dispersed in the electrostatic field are selectively adsorbed onto the tip portion of the raised naps under good dispersion state to obtain relatively stable application state of the powders. These powders are heated by, e.g., infrared heating to such extent that the surface of the applied resin powders is fused, thereby to fusion-bond the powders. Thus, objective product is obtained.

The drawing grammatically shows the enlarged cross-section of said product. That is, heat adhesive synthetic resin powders R of 80μ or less in particle size are fusion-bonded onto the tip portion of naps N which are distributed on the front side of a base fabric composed of yarns $Y_1$ and $Y_2$ and which are longer among others.

It is a matter of course that the method of this invention can be applied to a base fabric which is continuously moving.

Since in the fusible interlining of this invention the heat adhesive synthetic resin powders are applied only to the tip portion of naps on the surface of base fabric, this interlining can be very effectively bonded by hot pressing to a fabric superposed thereon and the bonded portion is extremely small because they are bonded through the naps and hence softness and air permeability of the bonded fabric can be satisfactorily maintained.

Furthermore, according to the method of this invention, it is very easy to uniformly distribute relatively small amount of resin powders on the surface of a base fabric and to apply them only to the tip portion of the naps.

This invention is further illustrated by the following examples wherein "part" and "%" are by weight.

EXAMPLE 1

(1) Dispersion of resin powders

A dispersion having a viscosity of 500 cp (20° C.) which was prepared by mixing and stirring 100 parts of water, one part of sodium acrylate dispersant and 30 parts of polyamide resin powders (particle size 80μ or less).

(2) Sprinkling conditions

An electrostatic coating apparatus provided with rotational spraying nozzle under operating conditions of rotation number of spray head: 50000–60000 rpm and applied voltage DC: 120 KV.

(3) Base fabric

A plain weave fabric prepared with 65 ends and 58 picks per inch of 85 count polyester 65% cotton 35% blended spun yarns.

The base fabric was horizontally placed and the spray head was positioned at a distance of 40 cm above the base fabric, from which the dispersion was sprinkled. Then, the resin powders were dried and fusion-bonded by heating with an infrared heater to obtain an interlining with the resin applied only to the tip portion of naps in an amount of 6 g/m$^2$.

COMPARATIVE EXAMPLES 1–3

The following three fusible interlinings were obtained by conventional method using the same base fabric and the same polyamide resin as used in Example 1.

COMPARATIVE EXAMPLE 1

An interlining of 6 g/m$^2$ in application amount of resin which was produced by random scattering of the resin of 100–150μ in particle size.

COMPARATIVE EXAMPLE 2

An interlining of 7 g/m$^2$ in resin application amount and 1225/inch$^2$ in dot density which was produced by application of the resin of 80μ or less in particle size by dot transfer method using an engraved roller.

COMPARATIVE EXAMPLE 3

An interlining of 8 g/m$^2$ in resin application amount and 900/inch$^2$ in dot density which was produced by screen printing of dispersion containing the resin of 80μ or less in particle size.

These interlinings are those which are practically used for application to light weight shell fabric.

The interlinings of Example 1 and Comparative Examples 1–3 were subjected to bonding test under the following conditions.

Shell fabric; Crepe de Chine of 100% silk (basis weight 45 g/m$^2$)

Bonding conditions; 140° C., 0.3 kg/cm$^2$, 10 seconds

Thus bonded fabrics were subjected to measurement of bond strength (by peeling at 180° ), visual examination of strike-through of resin to outer surface of the shell fabric, evaluation of handle with hands and measurement of strike-back of resin to the back side of the interlining under the following conditions and the results are shown in the following Table.

Measurement of strike-back: On both sides of the interlining were superposed poplin fabrics prepared with 108 ends and 100 picks per inch of 60 count polyester and cotton (65/35) blended spun yarns and these were bonded under the bonding conditions as mentioned above. Bond strength by 180° peeling of the cloth on the back side was measured.

TABLE

| | | Comparative Examples | | |
|---|---|---|---|---|
| | Example 1 | 1 | 2 | 3 |
| Bond strength (g/inch) | 150 | 150 | 180 | 150 |
| Strike-through | None | Found | Slightly found | Found occurred |
| Strike-back (g/inch) | 0 | 10 | 15 | 30 |
| Handle | Very | Somewhat | Soft | Hard |

TABLE-continued

| | Comparative Examples | | |
|---|---|---|---|
| Example 1 | 1 | 2 | 3 |
| soft | hard | | |

That is, the fusible interlining of Example 1 was bonded to the light weight shell fabric in excellent bonding state while the conventional fusible interlinings had the problem of deterioration in properties of the bonded fabrics.

EXAMPLE 2

In accordance with the procedure of Example 1, a fusible interlining of 6 g/m$^2$ in resin application amount was produced using the same resin dispersion except that polyester resin powders (80$\mu$ or less) were used in place of polyamide resin powders, under the same electrostatic coating conditions and using as a base fabric a woven fabric prepared with 65 ends and 58 picks per inch of 80 count of 100% polynosic spun yarns.

This fusible interlining was bonded to light weight shell fabric of crepe de Chine of 100% polyester (basis weight: 30 g/m$^2$) by hot pressing. An extremely soft bonded fabric which cannot be obtained with the conventional fusible interlinings was obtained without any problems mentioned in Example 1.

As explained hereabove, since the fusible interlining of this invention has heat adhesive synthetic resin powders applied to the tip portion of naps on a base fabric, bonding by hot pressing of it to a shell fabric can be easily and surely accomplished and useless penetration of resin into both shell fabric and base fabric of the interlining can be prevented. Thus, very soft bonded fabrics are obtained. This interlining is especially useful for application to light weight shell fabrics.

Furthermore, according to the method for making the interlining of this invention, a relatively small amount of resin powders can be uniformly distributed on the surface of a base fabric and be applied to the tip portion of naps by utilizing electrostatic coating technique and fusible interlining of excellent quality can be produced efficiently.

What is claimed is:

1. A fusible interlining which comprises a base fabric having naps distributed thereon and heat adhesive synthetic resin powders applied mainly onto the surface of tip portion of said naps.

2. A fusible interlining according to claim 1 wherein the heat adhesive synthetic resin powders have a particle size of 80$\mu$ or less and the powders are fusion-bonded to the surface of the naps.

3. A fusible interlining according to claim 1 wherein the heat adhesive synthetic resin powders are powders of polyamide, polyester, polyethylene, polyurethane, polyvinyl chloride or ethylene-vinyl acetate copolymer.

4. A bonded fabric which comprises the fusible interlining of claim 1 and a shell fabric bonded to each other through the resin applied naps of the interlining.

5. A method for making the bonded fabric of claim 4 which comprises bonding by hot pressing the fusible interlining to the shell fabric.

6. A method for producing a fusible interlining which comprises sprinkling charged heat adhesive synthetic resin powders or a dispersion thereof or an emulsion of fine particles of said resin onto a number of naps distributed on a base fabric in the state of being raised from the surface of the base fabric in high voltage electrostatic field, thereby to apply the powders mainly to the tip portion of the naps and then heating the fabric to fusion-bond the powders to the surface of the naps.

7. A method for producing a fusible interlining according to claim 6 wherein the heat adhesive synthetic resin powders have a particle size of 80$\mu$ or less.

8. A method for producing a fusible interlining according to claim 6 wherein the heat adhesive synthetic resin powders are powders of polyamide, polyester, polyethylene, polyurethane, polyvinyl chloride or ethylenevinyl acetate copolymer.

9. A method for producing a fusible interlining according to claim 6 wherein the high voltage electrostatic field has a voltage gradient of 60–120 KV.

* * * * *